US011250769B2

(12) United States Patent
Wang et al.

(10) Patent No.: US 11,250,769 B2
(45) Date of Patent: Feb. 15, 2022

(54) COMPENSATION SYSTEM AND COMPENSATION METHOD FOR LIFE ATTENUATION OF OLED DEVICE

(71) Applicant: Shenzhen China Star Optoelectronics Semiconductor Display Technology Co., Ltd., Guangdong (CN)

(72) Inventors: Limin Wang, Guangdong (CN); Huasheng Su, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/765,483

(22) PCT Filed: Apr. 16, 2020

(86) PCT No.: PCT/CN2020/085121

§ 371 (c)(1),
(2) Date: May 20, 2020

(87) PCT Pub. No.: WO2021/196295

PCT Pub. Date: Oct. 7, 2021

(65) Prior Publication Data

US 2021/0304671 A1 Sep. 30, 2021

(30) Foreign Application Priority Data

Mar. 31, 2020 (CN) ..... 202010241836.6

(51) Int. Cl.
*G09G 3/3208* (2016.01)

(52) U.S. Cl.
CPC ... *G09G 3/3208* (2013.01); *G09G 2320/0233* (2013.01); *G09G 2320/045* (2013.01)

(58) Field of Classification Search
CPC ..... G09G 3/3208; G09G 2320/0233; G09G 2320/045
See application file for complete search history.

(56) References Cited

U.S. PATENT DOCUMENTS 6,414,661 B1 * 7/2002 Shen ..... G09G 3/3208 345/82
6,498,592 B1 * 12/2002 Matthies ..... G02F 1/13336 257/E25.032

(Continued)

FOREIGN PATENT DOCUMENTS

CN 103198790 A 7/2013
CN 106531069 A 3/2017

(Continued)

*Primary Examiner* — Ariel A Balaoing
(74) *Attorney, Agent, or Firm* — Mark M. Friedman

(57) ABSTRACT

A compensation system and a compensation method for life attenuation of an organic light emitting diode (OLED) device are provided to include a display data input module, an equivalent life calculation module, an OLED device attenuation degree calculation module, a display position weight ratio module, a life compensation data generation module, and a data compensation and display data output module. The life compensation data generation module is configured to generate final life compensation data according to a feedback result of the OLED device attenuation degree calculation module and the display position weight ratio module.

12 Claims, 3 Drawing Sheets

(56) References Cited

U.S. PATENT DOCUMENTS

| | | | | |
|---|---|---|---|---|
| 2001/0030513 | A1 | 10/2001 | Takada et al. | |
| 2004/0137749 | A1* | 7/2004 | Ying | H01L 21/32136 438/710 |
| 2007/0132665 | A1* | 6/2007 | Kent | H05B 33/08 345/45 |
| 2009/0174628 | A1* | 7/2009 | Wang | G09G 3/3225 345/76 |
| 2009/0195559 | A1* | 8/2009 | Verstraete | G02F 1/133611 345/690 |
| 2011/0130981 | A1* | 6/2011 | Chaji | G09G 3/3233 702/58 |
| 2011/0191042 | A1* | 8/2011 | Chaji | G09G 3/006 702/64 |
| 2011/0221937 | A1* | 9/2011 | Park | G06T 5/20 348/242 |
| 2014/0118426 | A1* | 5/2014 | Chun | G09G 3/3208 345/691 |
| 2014/0160142 | A1* | 6/2014 | Lee | G09G 3/3208 345/589 |
| 2017/0193933 | A1* | 7/2017 | Zhang | G09G 3/3611 |
| 2020/0058249 | A1 | 2/2020 | Ok et al. | |
| 2020/0152154 | A1 | 5/2020 | Chu et al. | |
| 2020/0265779 | A1* | 8/2020 | In | G09G 3/3225 |

FOREIGN PATENT DOCUMENTS

| | | | |
|---|---|---|---|
| CN | 107680528 | A | 2/2018 |
| CN | 109377945 | A | 2/2019 |
| CN | 106847176 | B | 5/2019 |
| CN | 110853581 | A | 2/2020 |

* cited by examiner

COMPENSATION SYSTEM AND COMPENSATION METHOD FOR LIFE ATTENUATION OF OLED DEVICE

FIELD OF INVENTION

The present disclosure relates to the field of display technologies, and more particularly to a compensation system and a compensation method for life attenuation of an organic light emitting diode (OLED) device.

BACKGROUND OF INVENTION

Organic light emitting diode (OLED) devices have many advantages, such as self-luminous, low driving voltage, high luminous efficiency, short response time, wide operating temperature range, etc., and are recognized by the industry as the most promising display devices.

However, due to process and manufacturing reasons, consistency of characteristics of OLED displays is poor, and uniformity compensation (De-Mura) is required to improve a display performance. In a display process of the OLED device, a driving unit and a light emitting unit such as a thin film transistor (TFT) device or the OLED device will have characteristic drift with time aging. This causes a display unevenness issue to worsen, and also needs to detect and compensate for device characteristic drift. At present, people in the industry have developed a variety of compensation schemes for issues of OLED device consistency and aging characteristics drift. However, most of solutions are for compensation of TFT device characteristics, and there is still a large space for optimization for compensation of a life attenuation of the OLED device.

Current solutions for life compensation of OLED devices mainly use external complementary pixel circuits (common 3T1C) to detect drift of OLED device characteristics, and then generate compensation data, but due to the need for special detection integrated circuit (IC) design in conjunction with pixel design, it is costly and technically difficult. Therefore, there is an urgent need for a compensation system and a compensation method for life attenuation of an OLED device to extend life of the OLED device while avoiding deviations in OLED brightness and time aging compensation model.

Technical Problem

Current solutions for life compensation of OLED devices mainly use external complementary pixel circuits (common 3T1C) to detect drift of OLED device characteristics, and then generate compensation data, but due to the need for special detection integrated circuit (IC) design in conjunction with pixel design, it is costly and technically difficult.

SUMMARY OF INVENTION

Embodiments of the present application provide a compensation system and a compensation method for life attenuation of an organic light emitting diode (OLED) device, which can extend life of the OLED device while ensuring a display performance of the OLED device and solve technical problems in the prior art, that is due to a need for special detection integrated circuit (IC) design in conjunction with pixel design, it is costly and technically difficult.

In a first aspect, an embodiment of the present application provides a life attenuation compensation system of an organic light emitting diode (OLED) device comprising a display data input module, an equivalent life calculation module, an OLED device attenuation degree calculation module, a display position weight ratio module, a life compensation data generation module, and a data compensation and display data output module. The display position weight ratio module is configured to set and generate position compensation data of the OLED device at each display position, and a position weight ratio of the display position weight ratio module comprises a position weight A set in a central 25% area display area, a position weight B set in a peripheral edge display area, and a position weight C located outside the center 25% area display area to the peripheral edge display area. The life compensation data generation module is configured to generate final life compensation data according to a feedback result of the OLED device attenuation degree calculation module and the display position weight ratio module.

In an embodiment of the present application, the display data input module is configured to output display data input by the OLED device to the equivalent life calculation module.

In an embodiment of the present application, the equivalent life calculation module is configured to calculate an attenuation degree of the display data within an equivalent life, and the OLED device life attenuation calculation module is configured to accumulate the attenuation degree of the equivalent life calculation module in each equivalent life to obtain a first life compensation data.

In an embodiment of the present application, the data compensation and display data output module uses the final life compensation data to compensate and output the display data to complete estimation and compensation of the life attenuation degree of the OLED device.

In an embodiment of the present application, a compensation target of the position weight C decreases linearly from inside to outside in an area from the center 25% area display area to the periphery edge display area.

In a second aspect, an embodiment of the present application provides a life attenuation compensation system of an organic light emitting diode (OLED) device comprising a display data input module, an equivalent life calculation module, an OLED device attenuation degree calculation module, a display position weight ratio module, a life compensation data generation module, and a data compensation and display data output module. The display position weight ratio module is configured to set and generate position compensation data of the OLED device at each display position, and the life compensation data generation module is configured to generate final life compensation data according to a feedback result of the OLED device attenuation degree calculation module and the display position weight ratio module.

In an embodiment of the present application, the display data input module is configured to output display data input by the OLED device to the equivalent life calculation module.

In an embodiment of the present application, the equivalent life calculation module is configured to calculate an attenuation degree of the display data within an equivalent life, and the OLED device life attenuation calculation module is configured to accumulate the attenuation degree of the equivalent life calculation module in each equivalent life to obtain a first life compensation data.

In an embodiment of the present application, the data compensation and display data output module uses the final life compensation data to compensate and output the display data to complete estimation and compensation of the life attenuation degree of the OLED device.

An embodiment of the present application further provides a life attenuation compensation method of an OLED device comprising S10, providing a display data input module, wherein the display data input module is configured to input display data of the OLED device, S20, calculating an attenuation degree of the display data input by the display data input module within an equivalent life by an equivalent life calculation module, S30, accumulating an attenuation degree of the equivalent life calculation module in each equivalent life to obtain a first life compensation data by an OLED device life attenuation calculation module, S40, setting and generating position compensation data of the OLED device at each display position by a display position weight ratio module, S50, generating final life compensation data according to a feedback result of the first life compensation data and the position compensation data by a life compensation data generation module, and S60, using the final life compensation data to compensate and output the display data to complete estimation and compensation of the life attenuation degree of the OLED device by a data compensation and display data output module.

In an embodiment of the present application, in S40, the display position weight ratio module changes a life attenuation compensation target of the OLED device by adjusting a position weight ratio thereof.

In an embodiment of the present application, the position weight ratio comprises a position weight A set in a central 25% area display area, a position weight B set in a peripheral edge display area, and a position weight C located outside the center 25% area display area to the peripheral edge display area.

In an embodiment of the present application, a compensation target of the position weight C decreases linearly from inside to outside in an area from the center 25% area display area to the periphery edge display area.

Beneficial Effect:

Compared with the prior art, in the compensation system and compensation method for life attenuation of the OLED device provided by the embodiments of the present application, by adding consideration of a display position weighting factor to the compensation system, life of the OLED device is extended while ensuring a display performance of the OLED device, which further weakens an edge residual image generated by the OLED device and further reduces power consumption of the OLED device.

DETAILED DESCRIPTION OF PREFERRED EMBODIMENTS

For a compensation system and a compensation method for life attenuation of an OLED device in the prior art, a special detection integrated circuit (IC) design is required to cooperate with a pixel design, resulting in a technical problem of high compensation cost and high technical difficulty. Embodiments of the present application can solve this defect.

Figure 1:
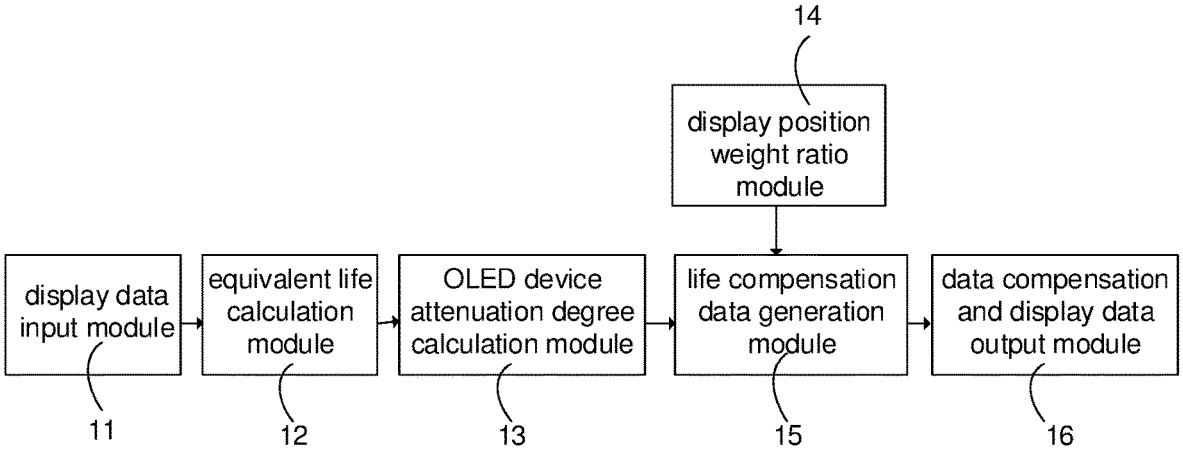
FIG. 1 is a schematic structural diagram of a life attenuation compensation system of an OLED device provided by an embodiment of the present application.

Referring to FIG. 1, which is a schematic structural diagram of a life attenuation compensation system of an OLED device provided by an embodiment of the present application. A life attenuation compensation system of the OLED device comprises a display data input module 11, an equivalent life calculation module 12, an OLED device attenuation degree calculation module 13, a display position weight ratio module 14, a life compensation data generation module 15, and a data compensation and display data output module 16.

The display position weight ratio module 14 is configured to set and generate position compensation data of the OLED device at each display position, and the life compensation data generation module 15 is configured to generate final life compensation data according to a feedback result of the OLED device attenuation degree calculation module 13 and the display position weight ratio module 14.

In details, the display data input module 11 is configured to output display data input by the OLED device to the equivalent life calculation module 12.

In details, the equivalent life calculation module 12 is configured to calculate an attenuation degree of the display data within an equivalent life, and the OLED device life attenuation calculation module 13 is configured to accumulate the attenuation degree of the equivalent life calculation module 12 in each equivalent life to obtain a first life compensation data.

In details, the data compensation and display data output module 16 uses the final life compensation data to compensate and output the display data to complete estimation and compensation of the life attenuation degree of the OLED device.

Figure 2:
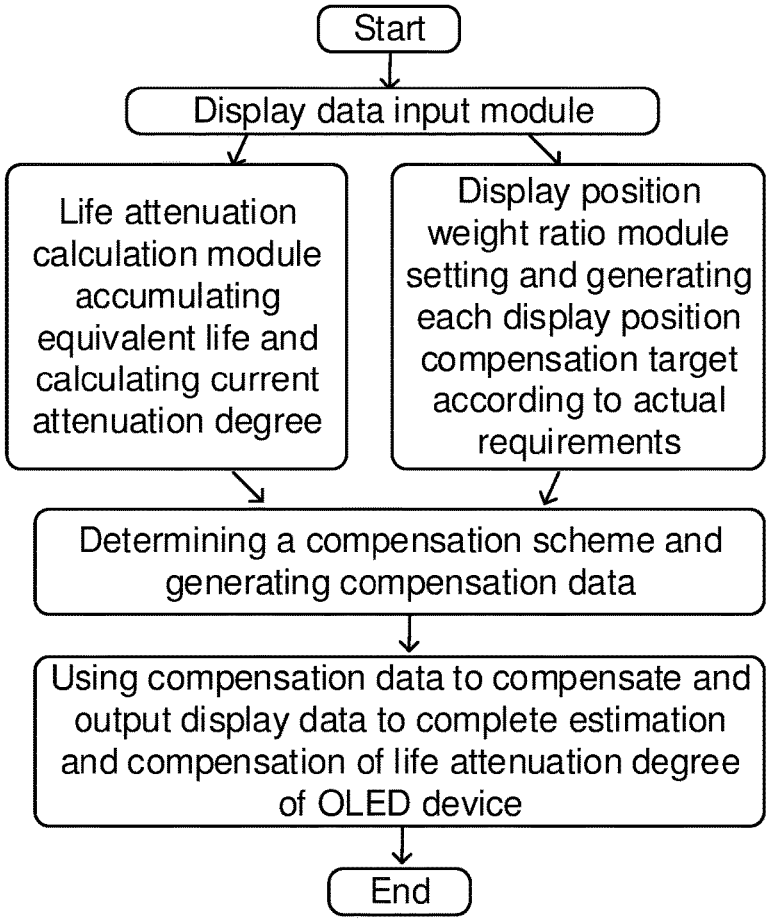
FIG. 2 is a flowchart of implementing a life attenuation compensation system of an OLED device provided by an embodiment of the present application.

Referring to FIG. 2, which is a flowchart of implementing a life attenuation compensation system of an OLED device provided by an embodiment of the present application. The working principle of the life attenuation compensation system is as follows:

First, the OLED device starts to provide a display image, and inputs display data to the display data input module 11. The display data input module 11 outputs the received display data to the equivalent life calculation module 12. The equivalent life calculation module 12 calculates attenuation degree of the display data within the equivalent life, and transmits a calculation result to the OLED device life attenuation calculation module 13. The OLED device life attenuation calculation module 13 accumulates the attenuation degree of the equivalent life calculation module 12 in each equivalent life to obtain a first life compensation data. At the same time, the display position weight ratio module 14 is configured to set and generate position compensation data of the OLED device at each display position according to actual requirements. After that, the life compensation data generation module 15 generates a final life compensation according to the first life compensation data fed back by the OLED device attenuation calculation module 13 and the position compensation data fed back by the display position weight ratio module 14. Finally, the data compensation and display data output module 16 uses the final life compensation data to compensate and output the display data to complete estimation and compensation of the life attenuation degree of the OLED device.

Figure 3:
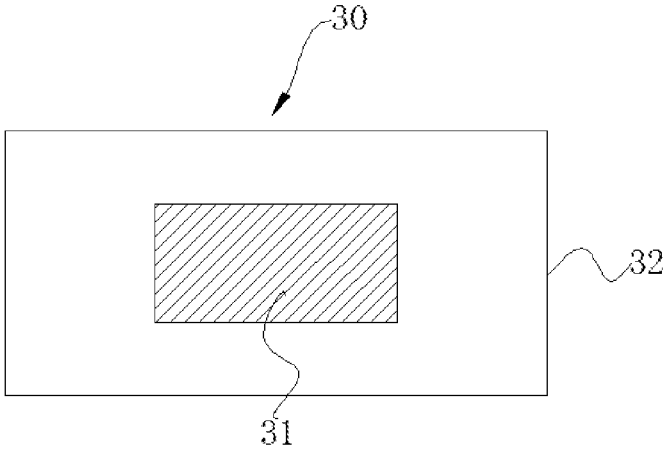
FIG. 3 is a setting diagram of display area position weights in a life attenuation compensation system of an OLED device provided by the embodiment of the present application.

Referring to FIG. 3, which is a setting diagram of display area position weights in a life attenuation compensation system of an OLED device provided by the embodiment of the present application. A display area 30 of the OLED device is divided into a central 25% area display area 31, a peripheral edge display area 32, and a portion of the display area 30 between the two. Accordingly, it can be set that a position weight ratio of the display position weight ratio module 14 comprises a position weight A set in a central 25% area display area, a position weight B set in a peripheral edge display area, and a position weight C located outside the center 25% area display area to the peripheral edge display area.

In details, a compensation target of the position weight C decreases linearly from inside to outside in an area from the center 25% area display area to the periphery edge display area.

In details, the position weight of the display position weight ratio module 14 can be parameterized and flexibly set, and the compensation target can be selectively changed by adjusting the position weight ratio, such that a display performance, life, and power consumption of the OLED device can be adjusted.

Further, the display position weight ratio module 14 may set a frame skipping compensation target of the position weight ratio according to different display positions, determine a compensation scheme according to the attenuation degree, generate compensation data, and finally complete the compensation of the life of the OLED device. In this way, the life of the OLED device is prolonged while the display performance is guaranteed, the edge residual image is weakened, and the power consumption is reduced.

In a preferred embodiment, the center 25% area compensation target is A=0.95, and the peripheral edge compensation target is B=0.8. According to the position weight ratio, the compensation target from 25% area to the edge area is linear decrease from inside to outside A→B. Together, the position compensation data is formed. The position compensation data is combined with the first life compensation data to generate finally generated life compensation data and is compensated and displayed.

Further, the life attenuation compensation system of the OLED device provided by the embodiments of the present application can have multiple implementation schemes, and the design is flexible and changeable, and can be adjusted according to different specific application fields to optimize the cost and effect.

Figure 4:
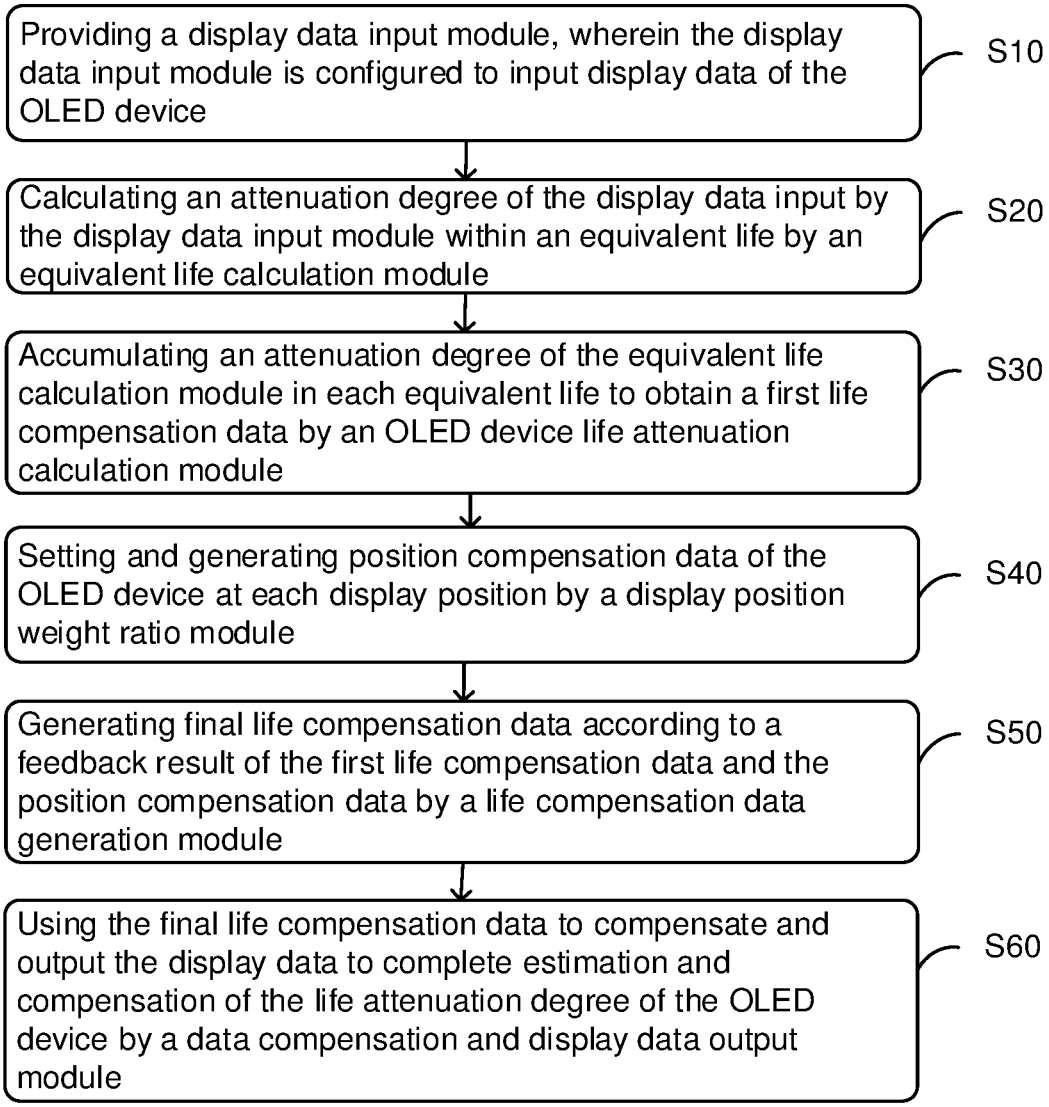
FIG. 4 is a schematic flowchart of a life attenuation compensation method of an OLED device provided by an embodiment of the present application.

Referring to FIG. 4, which is a schematic flowchart of a life attenuation compensation method of an OLED device provided by an embodiment of the present application. The method comprises as follows:

S10, providing a display data input module, wherein the display data input module is configured to input display data of the OLED device.

S20, calculating an attenuation degree of the display data input by the display data input module within an equivalent life by an equivalent life calculation module.

S30, accumulating an attenuation degree of the equivalent life calculation module in each equivalent life to obtain a first life compensation data by an OLED device life attenuation calculation module.

S40, setting and generating position compensation data of the OLED device at each display position by a display position weight ratio module.

S50, generating final life compensation data according to a feedback result of the first life compensation data and the position compensation data by a life compensation data generation module.

S60, using the final life compensation data to compensate and output the display data to complete estimation and compensation of the life attenuation degree of the OLED device by a data compensation and display data output module.

In details, in S40, the display position weight ratio module changes a life attenuation compensation target of the OLED device by adjusting a position weight ratio thereof.

Further, the position weight ratio comprises a position weight A set in a central 25% area display area, a position weight B set in a peripheral edge display area, and a position weight C located outside the center 25% area display area to the peripheral edge display area.

Further, a compensation target of the position weight C decreases linearly from inside to outside in an area from the center 25% area display area to the periphery edge display area.

The display position weight ratio module may set a frame skipping compensation target of the position weight ratio according to different display positions, determine a compensation scheme according to the attenuation degree, generate compensation data, and finally complete the compensation of the life of the OLED device. In this way, the life of the OLED device is prolonged while the display performance is guaranteed, the edge residual image is weakened, and the power consumption is reduced.

In a preferred embodiment, the center 25% area compensation target is A=0.95, and the peripheral edge compensation target is B=0.8. According to the position weight ratio, the compensation target from 25% area to the edge area is linear decrease from inside to outside A→B. Together, the position compensation data is formed. The position compensation data is combined with the first life compensation data to generate finally generated life compensation data and is compensated and displayed.

Further, the life attenuation compensation system of the OLED device provided by the embodiments of the present application can have multiple implementation schemes, and the design is flexible and changeable, and can be adjusted according to different specific application fields to optimize the cost and effect.

The specific implementation of the above operations can refer to the previous embodiments, and will not be repeated here.

In summary, in the compensation system and compensation method for life attenuation of the OLED device provided by the embodiments of the present application, by adding consideration of a display position weighting factor to the compensation system, life of the OLED device is extended while ensuring a display performance of the OLED device, which further weakens an edge residual image generated by the OLED device and further reduces power consumption of the OLED device.

It can be understood that, for those of ordinary skill in the art, equivalent replacements or changes can be made according to the technical solution of the present application and the inventive concept thereof. All these changes or replacements should fall within the protection scope of the claims attached to this application.

What is claimed is:

1. A life attenuation compensation system of an organic light emitting diode (OLED) device, comprising:

a display data input module; an equivalent life calculation module; an OLED device attenuation degree calculation module; a display position weight ratio module; a life compensation data generation module; and a data compensation and display data output module;

wherein the display position weight ratio module is configured to set and generate position compensation data of the OLED device at each display position, and a position weight ratio of the display position weight ratio module comprises a position weight A set in a central 25% area display area, a position weight B set in a peripheral edge display area, and a position weight C located outside the center 25% area display area to the peripheral edge display area; the life compensation data generation module is configured to generate final life compensation data according to a feedback result of the OLED device attenuation degree calculation module and the display position weight ratio module.

2. The life attenuation compensation system of the OLED device according to claim 1, wherein the display data input module is configured to output display data input by the OLED device to the equivalent life calculation module.

3. The life attenuation compensation system of the OLED device according to claim 2, wherein the equivalent life calculation module is configured to calculate an attenuation degree of the display data within an equivalent life, and the OLED device life attenuation calculation module is configured to accumulate the attenuation degree of the equivalent life calculation module in each equivalent life to obtain a first life compensation data.

4. The life attenuation compensation system of the OLED device according to claim 3, wherein the data compensation and display data output module uses the final life compensation data to compensate and output the display data to complete estimation and compensation of the life attenuation degree of the OLED device.

5. The life attenuation compensation system of the OLED device according to claim 1, wherein a compensation target of the position weight C decreases linearly from inside to outside in an area from the center 25% area display area to the periphery edge display area.

6. A life attenuation compensation system of an organic light emitting diode (OLED) device, comprising:

a display data input module; an equivalent life calculation module; an OLED device attenuation degree calculation module; a display position weight ratio module; a life compensation data generation module; and a data compensation and display data output module;

wherein the display position weight ratio module is configured to set and generate position compensation data of the OLED device at each display position; the life compensation data generation module is configured to generate final life compensation data according to a feedback result of the OLED device attenuation degree calculation module and the display position weight ratio module.

7. The life attenuation compensation system of the OLED device according to claim 6, wherein the display data input module is configured to output display data input by the OLED device to the equivalent life calculation module.

8. The life attenuation compensation system of the OLED device according to claim 7, wherein the equivalent life calculation module is configured to calculate an attenuation degree of the display data within an equivalent life, and the OLED device life attenuation calculation module is configured to accumulate the attenuation degree of the equivalent life calculation module in each equivalent life to obtain a first life compensation data.

9. The life attenuation compensation system of the OLED device according to claim 8, wherein the data compensation and display data output module uses the final life compensation data to compensate and output the display data to complete estimation and compensation of the life attenuation degree of the OLED device.

10. A life attenuation compensation method of an OLED device, comprising,

S10, providing a display data input module, wherein the display data input module is configured to input display data of the OLED device;

S20, calculating an attenuation degree of the display data input by the display data input module within an equivalent life by an equivalent life calculation module;

S30, accumulating an attenuation degree of the equivalent life calculation module in each equivalent life to obtain a first life compensation data by an OLED device life attenuation calculation module;

S40, setting and generating position compensation data of the OLED device at each display position by a display position weight ratio module;

S50, generating final life compensation data according to a feedback result of the first life compensation data and the position compensation data by a life compensation data generation module; and S60, using the final life compensation data to compensate and output the display data to complete estimation and compensation of the life attenuation degree of the OLED device by a data compensation and display data output module;

wherein the position weight ratio comprises a position weight A set in a central 25% area display area, a position weight B set in a peripheral edge display area, and a position weight C located outside the center 25% area display area to the peripheral edge display area.

11. The life attenuation compensation method of the OLED device according to claim 10, wherein in S40, the display position weight ratio module changes a life attenuation compensation target of the OLED device by adjusting a position weight ratio thereof.

12. The life attenuation compensation method of the OLED device according to claim 10, wherein a compensation target of the position weight C decreases linearly from inside to outside in an area from the center 25% area display area to the periphery edge display area.

* * * * *